US009334829B2

(12) United States Patent
Kisaichi et al.

(10) Patent No.: US 9,334,829 B2
(45) Date of Patent: May 10, 2016

(54) INTERNAL COMBUSTION ENGINE

(75) Inventors: Toru Kisaichi, Wako (JP); Hitoshi Yokotani, Wako (JP); Hiroshi Sotani, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 275 days.

(21) Appl. No.: 13/603,625

(22) Filed: Sep. 5, 2012

(65) Prior Publication Data

US 2013/0081584 A1 Apr. 4, 2013

(30) Foreign Application Priority Data

Sep. 29, 2011 (JP) ..... 2011-214360

(51) Int. Cl.
*F02P 15/02* (2006.01)
*F02F 1/24* (2006.01)

(52) U.S. Cl.
CPC *F02F 1/242* (2013.01); *F02P 15/02* (2013.01)

(58) Field of Classification Search
CPC ..... F02F 1/4214; F02F 1/38; F02F 1/40; F02F 1/242; F02P 15/02
See application file for complete search history.

(56) References Cited

U.S. PATENT DOCUMENTS

2010/0132639 A1* 6/2010 Poschl et al. ..... 123/41.79

FOREIGN PATENT DOCUMENTS

| | | | | |
|---|---|---|---|---|
| JP | 2-139304 | U | | 11/1990 |
| JP | 08-082244 | A | | 3/1996 |
| JP | 2009-162084 | A | | 7/2009 |
| JP | 2009162084 | A | * | 7/2009 |
| WO | 2007/080654 | A1 | | 7/2007 |

* cited by examiner

*Primary Examiner* — Lindsay Low
*Assistant Examiner* — Jacob Amick
(74) *Attorney, Agent, or Firm* — Squire Patton Boggs (US) LLP

(57) ABSTRACT

An internal combustion engine can include a first ignition plug disposed on the inner side of a range surrounded by a plurality of intake valves and a plurality of exhaust valves with a cylinder head viewed in parallel to a cylinder axial line and standing uprightly along the cylinder axial line. A second ignition plug is inclined with respect to the cylinder axial line on the outer side of the range. The second ignition plug is disposed on the opposite side to a valve driving mechanism with respect to the cylinder axial line on the outer side of the range.

15 Claims, 11 Drawing Sheets

(a)

(b)

(a)

(b)

INTERNAL COMBUSTION ENGINE

BACKGROUND

1. Field

This invention relates to a cylinder head structure of an internal combustion engine.

2. Description of the Related Art

Conventionally, in an internal combustion engine, two ignition plugs are sometimes provided on a cylinder head for example, refer to Japanese Patent No. 3438343 (Patent Document 1). In this example, in an OHC (overhead cam) engine, the ignition plugs are disposed in parallel to each other obliquely with respect to a cylinder axial line while avoiding a valve system.

SUMMARY

An engine performance and enhancement of a maintenance performance by application of twin plugs are achieved while a disposition space, not only for intake and exhaust valves, but also for a valve driving mechanism such as a camshaft, is assured and increase in size of an engine main body is suppressed.

Therefore, it is an object of certain embodiments of the present invention to achieve enhancement of an engine performance while increase in size of an engine main body is suppressed in an internal combustion engine in which two ignition plugs are provided on a cylinder head.

As means for solving the subject described above, the invention according to one embodiment provides an internal combustion engine of the overhead valve type in which a plurality of intake valves and a plurality of exhaust valves disposed in an opposing relationship to a piston are disposed on the opposite sides between which a plane passing a cylinder axial line of a cylinder head is sandwiched. The engine can include a first ignition plug disposed on the inner side of an area surrounded by the plural intake valves and the plural exhaust valves with the cylinder head viewed in parallel to the cylinder axial line and standing uprightly along the cylinder axial line. A second ignition plug is inclined with respect to the cylinder axial line on the outer side of the area. The second ignition plug is disposed on the opposite side to a valve driving mechanism with respect to the cylinder axial line on the outer side of the area.

According to another embodiment of the invention, the cylinder axial line is inclined with respect to a vertical direction. The cylinder head can include a first plug hole which accommodates the first ignition plug therein, a second plug hole which is placed at a lower position in the vertical direction than that of the first plug hole and accommodates the second ignition plug therein, and a communicating passage extending from a bottom portion of the first plug hole to the second plug hole.

In another embodiment, the internal combustion engine can further include a water jacket for cooling in the inside of the cylinder head. A cooling water passage for communicating the water jacket of the cylinder head and a water jacket of a cylinder main body is opened at a portion of a mating face of the cylinder head with the cylinder main body in the proximity of the second plug hole.

In another embodiment, the internal combustion engine can further include an intake port configured to communicate two intake downstream side openings, which are opened and closed by the intake valves, and a single intake upstream side opening, to which an intake system part is connected, with each other. The intake port offsets a center position of the intake upstream side opening to the second ignition plug side in one direction of a cylinder leftward and rightward direction of the intake downstream side openings with respect to a center position between the intake downstream side openings in the one direction of the cylinder leftward and rightward direction with the cylinder head viewed in parallel to the cylinder axial line.

In another embodiment, the second ignition plug ignites after ignition of the first ignition plug at one combustion step.

In some embodiments, different from an OHC engine in which the valve driving mechanism, which can be a camshaft or the like, is disposed on the inner side of the area, the internal combustion engine is an OHV engine in which the valve driving mechanism is disposed on the outer side of the area. Therefore, the first and second plugs are disposed such that the central axial lines thereof are directed to the center direction of the combustion chamber while the valve system is made compact. Consequently, it is possible to optimally control the ignition timing to achieve enhancement of the engine performance while the size of the engine main body is reduced.

In some embodiments, it is made possible to guide rainwater and so forth accumulated in the first plug hole, into the second plug hole, and through the communicating passage to discharge the rainwater and so forth to the outer side of the cylinder head and simplify the draining structure.

In other embodiments, the periphery of the second ignition plug can be positively cooled, and the temperature difference from the first ignition plug can be reduced thereby to stabilize the ignition timing characteristic.

In other embodiments, fuel adhesion to the electrode portions at the end of the second ignition plug can be prevented while the arriving speed of fuel air mixture at the periphery of the second ignition plug is increased, and the ignition performance can be enhanced to achieve enhancement of the engine performance.

In other embodiments, abnormal combustion can be prevented even if lean fuel air mixture is used while the increase of the combustion pressure is moderated to reduce the load on the engine structure members. The emission performance can also be enhanced by combustion improvement by the application of twin plugs.

DETAILED DESCRIPTION

In the following, embodiments of the present invention are described with reference to the drawings. It is to be noted that, unless otherwise specified, such directions as forward, rearward, leftward and rightward directions are the same as those on a vehicle to be described below. Further, at suitable positions in the figures used in the following description, an arrow mark FR indicative of the vehicle forward direction, another arrow mark LH indicative of the vehicle leftward direction, and a further arrow mark UP indicative of the vehicle upward direction are shown.

Figure 1:
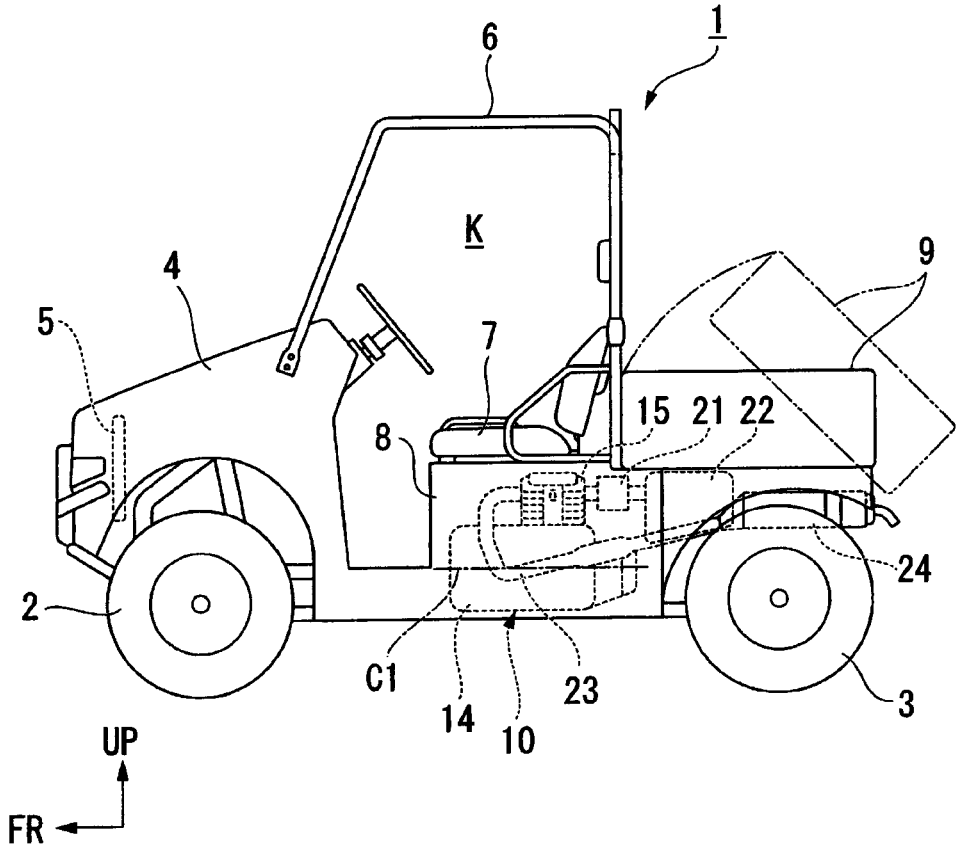
FIG. 1 is a left side elevational view of a vehicle having an engine according to embodiments of the present invention.

A vehicle shown in FIG. 1 is a vehicle such as an MUV (multi-utility vehicle) 1. In this example, the vehicle is of a comparative small size designed principally for running on a rough terrain and is configured as a four-wheeled car having a pair of left and right front wheels 2 and a pair of left and right rear wheels 3 on the front side and the rear side thereof, respectively.

The vehicle 1 has, at a front portion of a vehicle body thereof at which the left and right front wheels 2 are provided, a bonnet or hood 4 mounted for upwardly and downwardly opening and closing movement through a hinge or the like, and a radiator 5 disposed on the inner side of a front portion of the bonnet 4. The vehicle 1 can have, at a mid portion of the vehicle body thereof in which an occupant space K is formed, a roll bar 6 surrounding the periphery of the occupant space K, a seat 7 for being seated by an occupant, an engine 10 disposed below the seat 7, and a vehicle body cover 8 for covering the periphery of the engine 10 and supporting the seat 7. A movable carrier 9 is provided at a rear portion of the vehicle body at which the left and right rear wheels 3 are provided.

Figure 2:
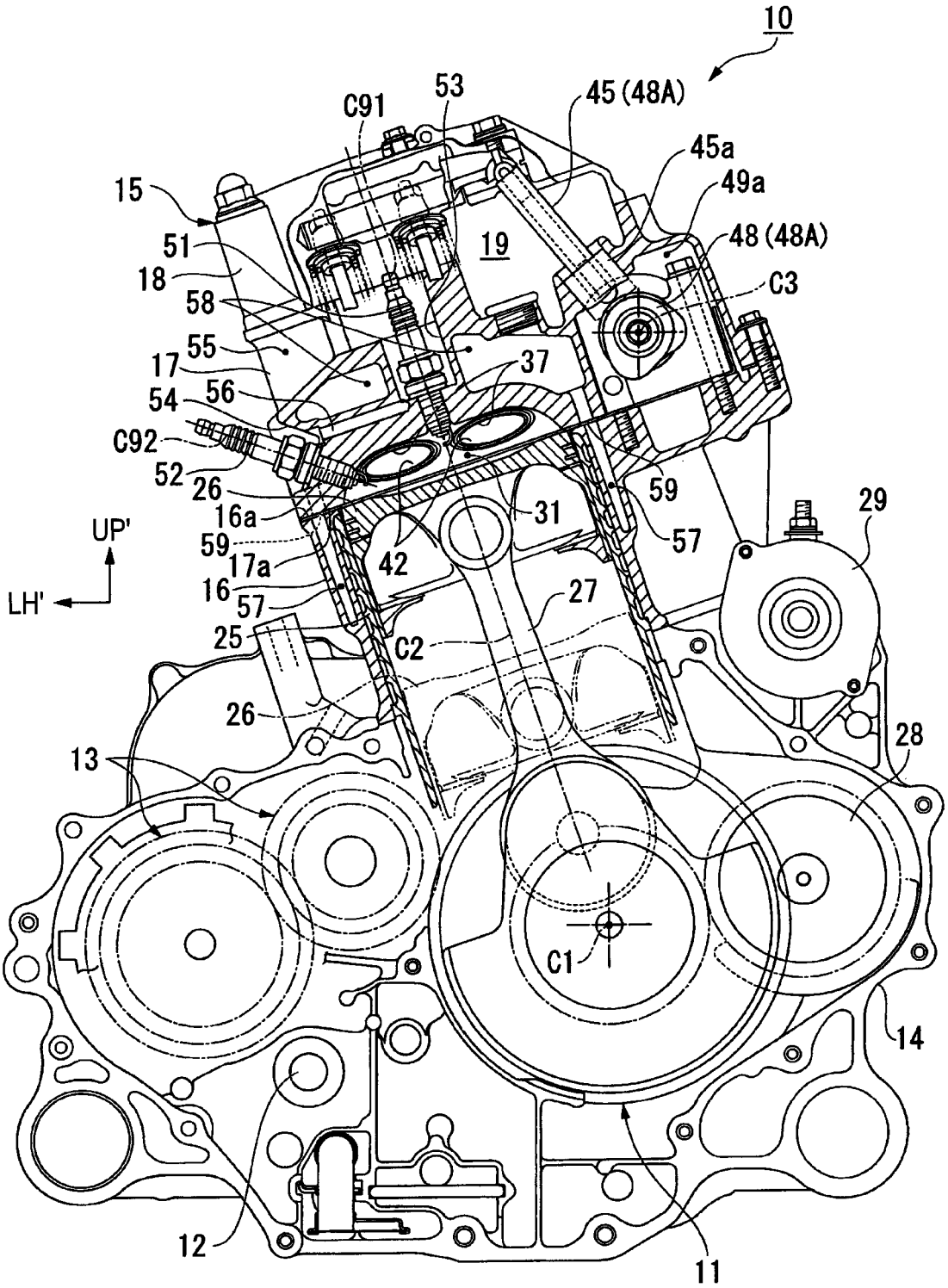
FIG. 2 is a rear elevational view of the vehicle.

Referring also to FIG. 2, the engine 10 is a prime mover of the vehicle 1 and is placed in a so-called vertical placement in which rotational center axial line (crank axial line) C1 of a crankshaft 11 extends in the forward and backward direction of the vehicle. Driving force of the engine 10 is transmitted to the left and right front wheels 2 and the left and right rear wheels 3 through a propeller shaft, a differential mechanism and so forth not shown. On the left side of a lower portion of the engine 10, an output power shaft 12 to which the propeller shaft is connected projects forwardly and rearwardly.

The engine 10 has a crankcase 14 in which the crankshaft 11 and a transmission 13 are accommodated. The engine 10 also has a cylinder 15 erected uprightly on the crankcase 14.

The cylinder 15 stands uprightly in an inclined relationship such that the upper side thereof is positioned on the left side. In particular, to achieve a lower arrangement of the center of gravity and enhancement in getting on and off, the cylinder 15 standing uprightly on the crankcase 14 in the engine 10 disposed below the seat 7 is inclined so that the height of the seat 7 is suppressed. It is to be noted that reference symbol C2 indicates an axial line (cylinder axial line) extending along the uprightly standing direction of the cylinder 15.

The cylinder 15 has a cylinder main body 16 attached to the crankcase 14, a cylinder head 17 attached to an upper end portion of the cylinder main body 16, and a head cover 18 attached to an upper end portion of the cylinder head 17. The cylinder axial line C2 is a center axial line of a cylinder bore of the cylinder main body 16 and the cylinder head 17. The head cover 18 closes up an upper space of the cylinder head 17 to define a valve chamber 19. In the following description, an upward and downward direction along the cylinder axial line C2 of the cylinder 15 is referred to as cylinder upward and downward direction. Further, a leftward and rightward direction perpendicular to the cylinder axial line C2 is referred to as cylinder leftward and rightward direction. Additionally, an upward direction of the cylinder upward and downward direction in the figure is indicated by an arrow mark UP' and a leftward direction of the cylinder leftward and rightward direction is indicated by an arrow mark LH'.

Figure 3:
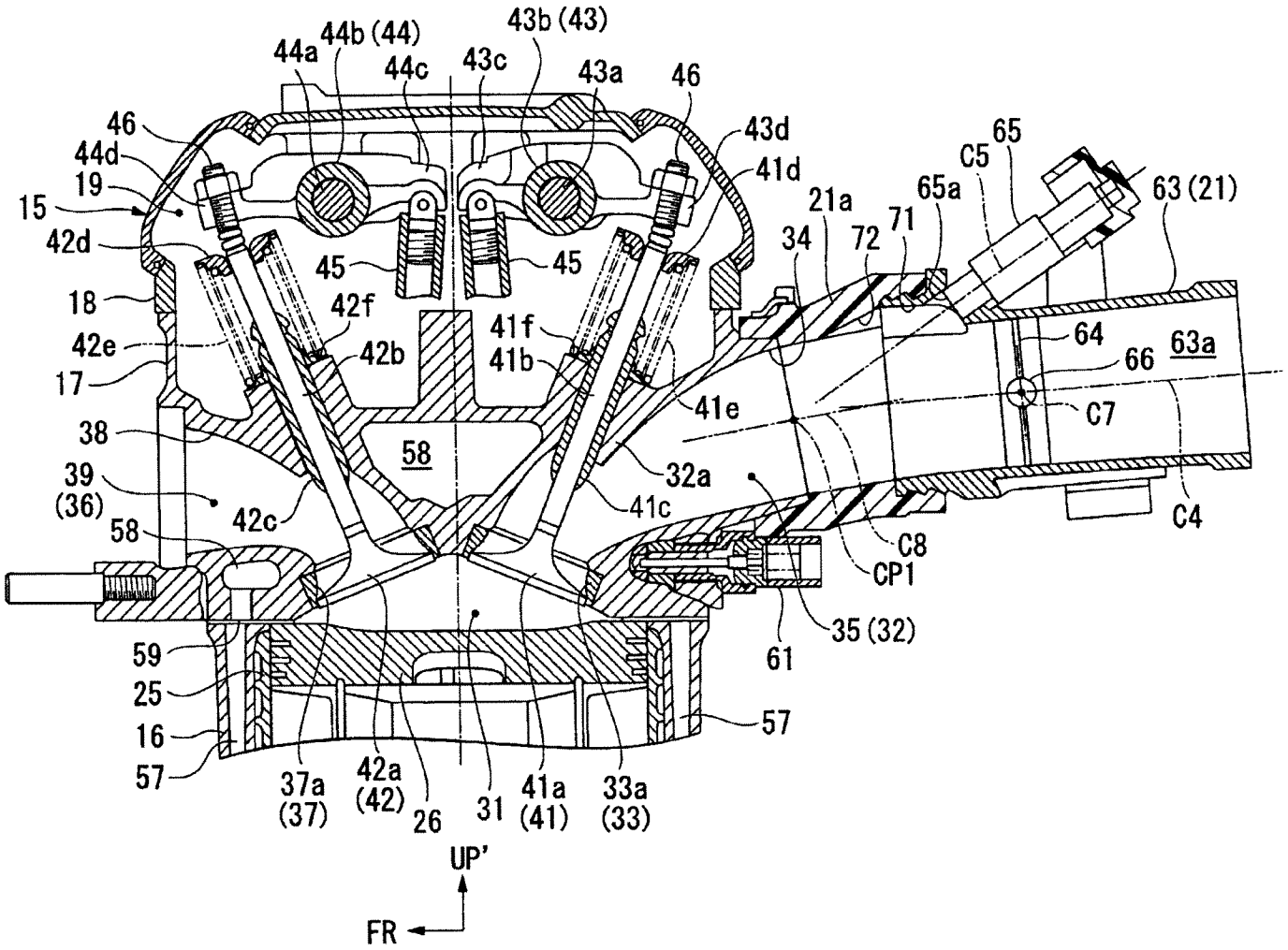
FIG. 3 is a sectional view taken along a cylinder axial line around a cylinder head of the engine.

Referring also to FIG. 3, intake system parts 21A such as a throttle body 21 and an air cleaner 22 are connected to a rear portion of the cylinder head 17. An exhaust pipe 23 is connected at a base end portion thereof to a front portion of the cylinder head 17. Leftwardly of the engine 10, the exhaust pipe 23 is folded back and extends rearwardly until it is connected to a silencer 24 disposed at a rear portion of the vehicle body.

A sleeve 25 which forms a cylinder bore is cast in the cylinder main body 16, and a piston 26 is fitted for back and forth movement in the sleeve 25. The piston 26 is connected to the crankshaft 11 through a connecting rod 27 so that back and forth movement of the piston 26 is converted into rotational movement of the crankshaft 11. It is to be noted that reference numeral 28 denotes a balancer, and reference numeral 29 denotes a starter motor.

The cylinder head 17 cooperates with the piston 26 to form a combustion chamber 31 of the pent-roof type. In a region of the cylinder head 17 opposing an upper face of the piston 26, front and rear inclined faces are formed. The front and rear inclined faces exhibit a shallow inverted V shape as viewed in the cylinder leftward and rightward direction so as to form a ceiling of the combustion chamber 31. The engine 10 in this embodiment is a water-cooled four-valve OHV single cylinder engine, and a pair of left and right intake downstream side openings 33 are formed on the rear inclined face described above such that they are positioned along the cylinder leftward and rightward direction at an intake port 32. Meanwhile, on the front inclined face described above, a pair of leftward and rightward exhaust upstream side openings 37 are formed such that they are positioned along the cylinder leftward and rightward direction of an exhaust port 36. The left and right intake downstream side openings 33 are opened and closed by left and right intake valves 41, and the left and right exhaust upstream side openings 37 are opened and closed by left and right exhaust valves 42.

Figure 4:
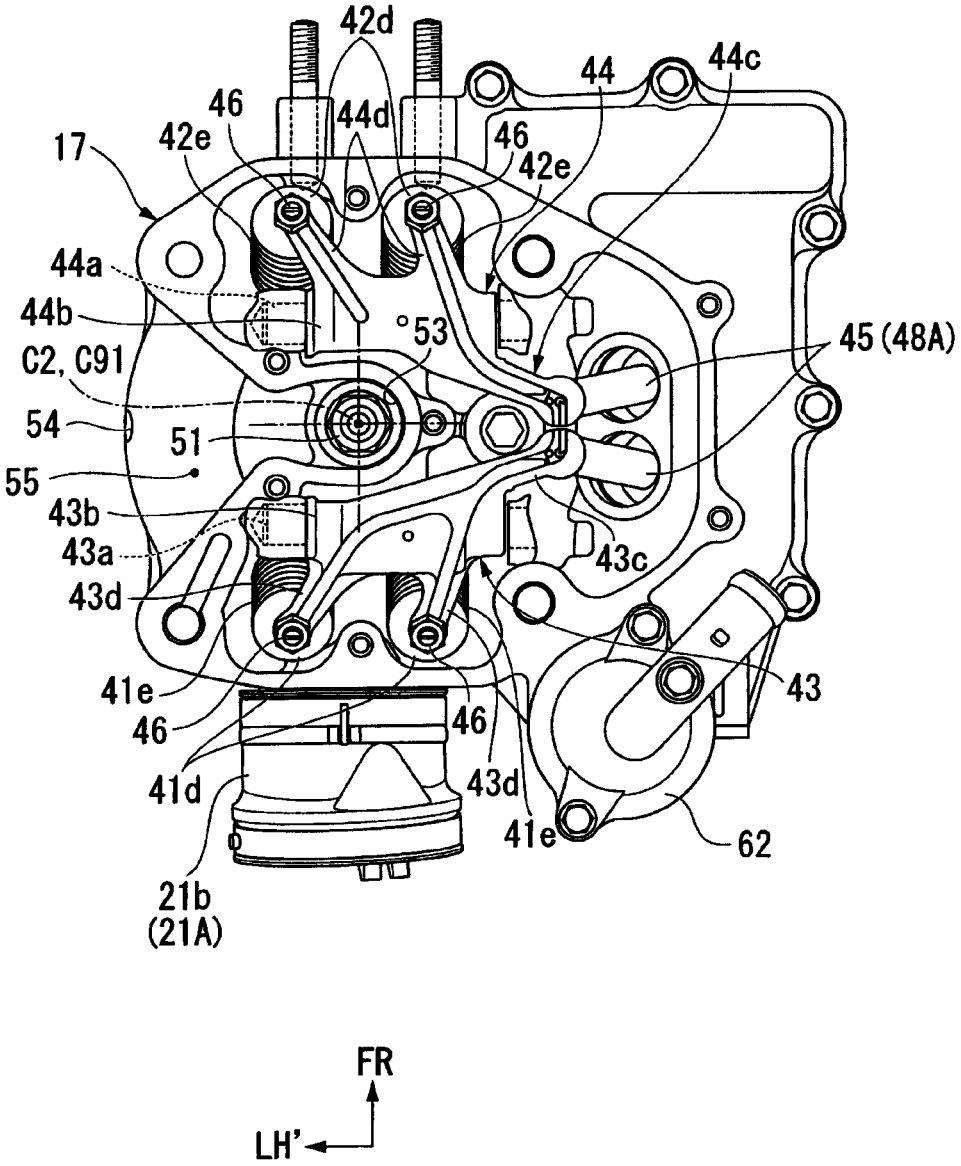
FIG. 4 is a top plan view taken along the cylinder axial line of the cylinder head.
Figure 5:
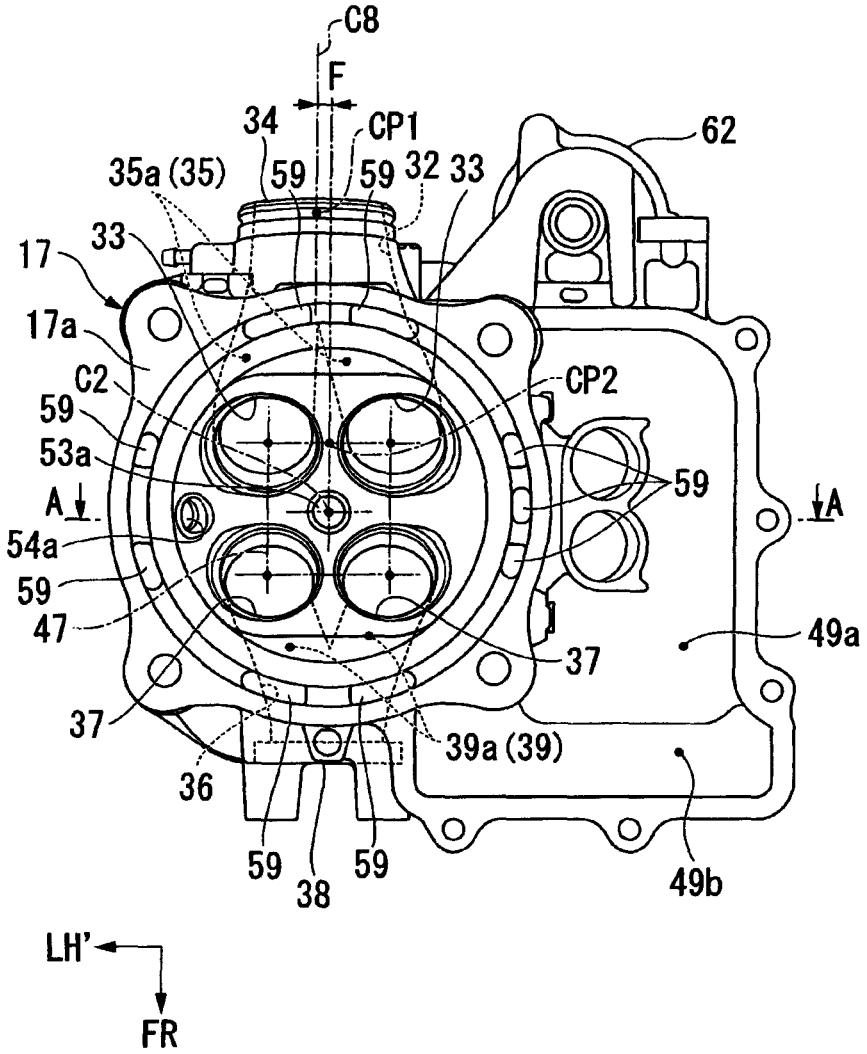
FIG. 5 is a bottom plan view taken along the cylinder axial line of the cylinder head.

Referring to FIGS. 3 to 5, the intake port 32 has the left and right intake downstream side openings 33 open inwardly of the combustion chamber 31, a single intake upstream side opening 34 open rearwardly on a rear face of the cylinder head 17, and a head internal intake passage 35 for communicating the left and right intake downstream side openings 33 and the intake upstream side opening 34 with each other. The intake port 32 (head internal intake passage 35) extends forwardly from the intake upstream side opening 34 of a circular shape and is branched to left and right branch passages 35*a* while being curved downwardly to the left and right intake downstream side openings 33 of a circular shape. A ring-shaped valve seat 33*a* is fitted in each of the left and right intake downstream side openings 33.

The exhaust port 36 has the left and right exhaust upstream side openings 37 open inwardly of the combustion chamber 31, a single exhaust downstream side opening 38 open forwardly on a front face of the cylinder head 17, and a head internal exhaust passage 39 for communicating the left and right exhaust upstream side openings 37 and the exhaust downstream side opening 38 with each other. The exhaust port 36 (head internal exhaust passage 39) extends upwardly from the left and right exhaust upstream side openings 37 of a circular shape and joins left and right branch passages 39*a* while being curved forwardly to the exhaust downstream side opening 38 of a circular shape. A ring-shaped valve seat 37*a* is fitted in each of the left and right exhaust upstream side openings 37.

A pair of left and right intake valves 41 is provided corresponding to the left and right intake downstream side openings 33. Each of the intake valves integrally has a conical valve head 41*a* for closely contacting an intake downstream side opening 33 (valve seat 33*a*) from the combustion chamber 31 side, and a bar-like stem 41*b* extending from a top portion of the valve head 41*a* to the inside of the valve chamber 19 through the cylinder head 17. At a place of the cylinder head 17 through which the stem 41*b* extends, a valve guide 41*c* for holding the stem 41*b* for stroke movement is provided fixedly. The valve guide 41*c* projects at a lower end portion thereof into the intake port 32. A projection 32*a* is formed on an inner wall of an upper portion of the intake port 32 such that the intake upstream side thereof is swollen smoothly so that intake air can easily ride over a lower end portion of the valve guide 41*c*.

A pair of left and right exhaust valves 42 is provided corresponding to the left and right exhaust upstream side openings 37. Each of the exhaust valves 42 integrally has a conical valve head 42*a* for closely contacting an exhaust upstream side opening 37 (valve seat 37*a*) from the combustion chamber 31 side, and a bar-like stem 42*b* extending from a top portion of the valve head 42*a* to the inside of the valve chamber 19 through the cylinder head 17. At a place of the cylinder head 17 through which the stem 42*b* extends, a valve guide 42*c* is fixedly provided to hold the stem 42*b* for stroke movement. The stems 41*b* and 42*b* of the intake and exhaust valves 41 and 42 are disposed in a V shape as viewed in the forward and backward direction.

A retainer 41*d* which supports an upper end portion of a valve spring 41*e* is mounted at an end portion of the stem 41*b* of the intake valve 41. A spring pedestal 41*f*, which supports a lower end portion of the valve spring 41*e*, is formed at a portion of the cylinder head 17 opposite the retainer 41*d*. The intake valve 41 is biased upwardly by a spring force of the valve spring 41*e* provided in a compressed state between the retainer 41*d* and the spring pedestal 41*f* to close up the intake downstream side opening 33. On the other hand, if the intake valve 41 is moved downwardly against the spring force, then the intake valve 41 opens the intake downstream side opening 33.

Similarly, a retainer 42*d*, which supports an upper end portion of a valve spring 42*e*, is mounted at an end portion of the stem 42*b* of the exhaust valve 42. A spring pedestal 42*f*, which supports a lower end portion of the valve spring 42*e*, is formed at a portion of the cylinder head 17 opposing to the retainer 42*d*. The exhaust valve 42 is biased upwardly by spring force of the valve spring 42*e* provided in a compressed state between the retainer 42*d* and the spring pedestal 42*f* to close up the exhaust upstream side opening 37. On the other hand, when the exhaust valve 42 is moved downwardly against the spring force, then the exhaust valve 42 opens the exhaust upstream side opening 37.

Left and right output arms 43*d* of an intake rocker arm 43 are engaged from above with a stem end of the left and right intake valves 41. Further, left and right output arms 44*d* of an exhaust rocker arm 44 are engaged from above with a stem end of the left and right exhaust valves 42. The rocker arms 43 and 44 are supported for rocking motion in the cylinder head 17 through rocker arm shafts 43*a* and 44*a* extending in the forward and backward direction, respectively.

The intake rocker arm 43 integrally has a cylindrical base portion 43*b* in which the rocker arm shaft 43*a* is fitted. The intake rocker arm 43 also integrally has a single input arm 43*c* extending rightwardly forwardly from a right front portion of the base portion 43*b*, and left and right output arms 43*d* extending leftwardly rearwardly from the left and right rear portions of the base portion 43*b*.

Similarly, the exhaust rocker arm 44 integrally has a cylindrical base portion 44*b* in which the rocker arm shaft 44*a* is fitted. The exhaust rocker arm 44 also integrally has a single input arm 44*c* extending rightwardly rearwardly from a right rear portion of the base portion 44*b*, and the left and right output arms 44*d* extending leftwardly forwardly from left and right front portions of the base portion 44*b*.

A pair of push rods 45 is engaged at an upper end portion thereof with end portions of the input arms 43*c* and 44*c* of the rocker arms 43 and 44. Tappet bolts 46 which engage with a stem end of the valves 41 and 42 are mounted at end portions of the left and right output arms 43*d* and 44*d* of the rocker arms 43 and 44.

The rocker arms 43 and 44 and the rocker arm shafts 43*a* and 44*a* are disposed at a substantially same height in the cylinder upward and downward direction. The rocker arms 43 and 44 and the rocker arm shafts 43*a* and 44*a* are spaced from each other in the forward and rearward direction such that a first ignition plug 51 hereinafter is removably mounted along the cylinder upward and downward direction. It is to be noted that the rocker arms 43 and 44 are positioned near to each other only at the input arms 43*c* and 44*c* thereof on the right side of the cylinder head 17. Here, reference numeral 47 in the figure denotes an area surrounded by the valves 41 and 42 as viewed in plan, in the axial direction of the cylinder head 17. The area is formed by interconnecting the centers of the valve heads 41*a* and 42*a* (corresponding to the centers of the intake downstream side openings 33 and the exhaust upstream side openings 37).

Referring also to FIG. 2, a single camshaft 48 having a rotational center axial line or camshaft line C3 parallel to the crank axial line C1 is disposed on the right side portion of the cylinder head 17. The camshaft 48 has cam lobes corresponding to the push rods 45 for integral rotation. With the cam lobes, the push rods 45 are engaged at a lower end portion thereof through lifters 45*a*. Each of the push rods 45 is inclined such that the upper side thereof in the cylinder upward and downward direction as viewed in the forward and backward direction is positioned on the left side in the cylinder leftward and rightward direction (cylinder axial line C2 side).

The camshaft 48 is driven to rotate in association with the crankshaft 11 through a transmission mechanism of, for example, the chain type. By the rotational driving of the camshaft 48, the push rods 45 are moved upwardly and downwardly in response to outer peripheral patterns of the cam lobes to generate driving force for the valves 41 and 42. The camshaft 48 and the push rods 45 are hereinafter referred to as valve driving mechanism 48A, which can act as a valve power generation mechanism.

By operation of the valve driving mechanism 48A, the rocker arms 43 and 44 are rocked to move the valves 41 and 42 upwardly and downwardly to open and close the intake downstream side opening 33 of the intake port 32 and the exhaust upstream side opening 37 of the exhaust port 36. It is to be noted that reference symbol 49*a* in the figures denotes a driving mechanism chamber provided on a right side portion of the cylinder head 17 for accommodating the valve driving mechanism 48A while reference symbol 49*b* denotes a transmission mechanism chamber provided forwardly of and contiguously to the driving mechanism chamber 49*a* for accommodating the transmission mechanism described hereinabove.

Here, the engine 10 is formed as a twin-plug engine in order to enhance the combustion performance to achieve enhancement of the output power and reduction in fuel cost. The first ignition plug 51 and a second ignition plug 52 of the engine 10 are disposed at two locations which are different in height from each other in the cylinder upward and downward direction.

In particular, the first ignition plug 51 is disposed coaxially with the cylinder axial line C2 at a central portion of the cylinder head 17, and the second ignition plug 52 is disposed at a left side portion of the cylinder head 17 in an inclined relationship with respect to the cylinder axial line C2 (inclined such that the upper side in the cylinder upward and downward direction is positioned on the left side in the cylinder leftward and rightward direction). Electrode portions of end portions of the ignition plugs 51 and 52 are disposed such that they are directed to the center of the combustion chamber 31. It is to be noted that reference symbols C91 and C92 in the figures denote center axial lines of the ignition plugs 51 and 52, respectively.

Figure 6:
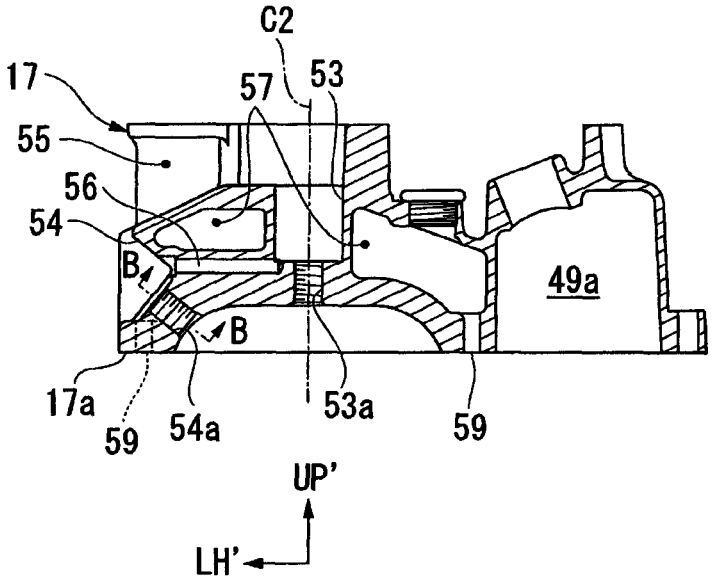
FIG. 6(*a*) is a sectional view taken along line A-A of FIG. 5, and FIG. 6(*b*) is a sectional view taken along line B-B of FIG. 6(*a*).
Figure 6:
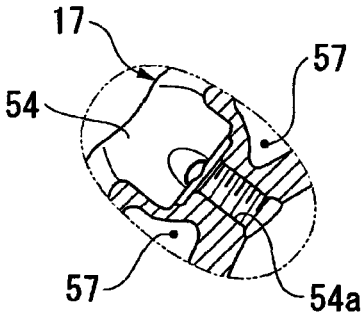

Referring also to FIG. 6(*a*), the cylinder head 17 has formed thereon first and second threaded holes 53*a* and 54*a* into which threaded portions of the first and second ignition plugs 51 and 52 are to be screwed, and counterbored first and second plug holes 53 and 54 for allowing the ignition plugs 51 and 52 to reach the threaded holes 53*a* and 54*a*, respectively. The first ignition plug 51 and the first plug hole 53 are disposed in the area 47 which is a space between the rocker arms 43 and 44 as viewed in the cylinder upward and downward direction and is surrounded by the valves 41 and 42.

The first plug hole 53 is open to the inside of an air jacket 55 formed so as to extend over the cylinder head 17 and the head cover 18. The air jacket 55 allows the first plug hole 53 to be open upwardly in the cylinder upward and downward direction and open in a leftwardly broadening manner in the cylinder leftward and rightward direction. The second plug hole 54 is open upwardly in the cylinder upward and downward direction and leftwardly in the cylinder leftward and rightward direction. A lower end portion of the second plug hole is shallow, and a lower end face of the second plug hole 54 is inclined leftwardly downwardly with respect to a horizontal direction (refer to FIG. 2).

The ignition plugs 51 and 52 are connected to ignition coils (not shown) separate from each other such that they are controlled so that the ignition timings thereof are made different from each other (in order to set a phase difference between the ignition timings). Consequently, while the combustion velocity of fuel air mixture is controlled, good combustion is made possible even where the fuel air mixture is lean thereby to achieve enhancement of the engine output power and the fuel cost. Enhancement of the emission performance is also achieved by improving combustion by employment of twin plugs.

A communicating passage (hole) 56 extending leftwardly in the cylinder leftward and rightward direction is open at a left end thereof to the left side of a bottom portion of the first plug hole 53. The communicating passage 56 is open at a right end thereof to the right side of a bottom portion of the second plug hole 54 and introduces rainwater and so forth in the first plug hole 53 into the second plug hole 54 making use of the inclination of the cylinder head 17. Since the second plug hole 54 is formed on the left side face of the cylinder head 17 which is inclined downwardly, the rainwater and so forth are easily discharged and the maintenance performance is good.

A cylinder side water jacket 57 is formed on the cylinder main body 16 in such a manner as to surround the outer side of an upper portion of the sleeve 25 (outer side of the combustion chamber 31). Meanwhile, a head side water jacket 58 is formed on the cylinder head 17 such that it extends over the cylinder head 17 while avoiding the ports 32 and 36, plug holes 53 and 54 and so forth.

The cylinder side water jacket 57 is open annularly at a mating face 16*a* of the cylinder main body 16 with the cylinder head 17. Meanwhile, on a mating face 17*a* of the cylinder head 17 with the cylinder main body 16, a plurality of head side openings 59 communicating with the head side water jacket 58 are formed along a circumference opposite the opening portion of the cylinder side water jacket 57 (refer to FIG. 5). The mating faces 16*a* and 17*a* between the cylinder main body 16 and the cylinder head 17 closely contact with each other with a gasket interposed therebetween such that the water jackets 57 and 58 are communicated with each other to allow distribution of cooling water therebetween.

Referring to FIGS. 5 and 6, the head side openings 59 are formed on the mating face 17*a* of the cylinder head 17 in such a manner as to sandwich the threaded hole 54*a* for the second ignition plug 52 therebetween in a cylinder circumferential direction. By cooling water immediately after flowing into the head side water jacket 58 from the head side openings 59, the threaded hole 54*a* and the second plug hole 54 connecting to the threaded hole 54*a* are favorably cooled, and the cooling performance for the second ignition plug 52 is assured. Consequently, the cooling performances for the first ignition plug 51 and the second ignition plug 52 surrounded by the head side water jacket 58 of a comparatively large size become equivalent to each other. As a result, stabilization of ignition timings is achieved and enhancement in productivity and maintenance performance by equalization in heat value between the ignition plugs 51 and 52 is anticipated.

It is to be noted that, as shown in FIG. 3, a water temperature sensor 61 for detecting the temperature of the cooling water immediately after flowing into the head side water jacket 58 from the cylinder side water jacket 57 is attached. Further, as shown in FIGS. 4 and 5, a thermostat case 62 is provided contiguously rearwardly of the driving mechanism chamber 49*a* of the cylinder head 17.

Referring to FIGS. 3 and 7 to 9, the throttle body 21 has a main body 63 in the form of a tube extending forwardly and rearwardly and forming a body internal intake passage 63*a* connecting to the head internal intake passage 35, a butterfly valve 64 supported for pivotal motion in the main body 63 for opening and closing the body internal intake passage 63*a*, and an injector 65 for injecting fuel to the downstream side with respect to the butterfly valve 64. The throttle body 21 is connected at a front end portion thereof to the intake port 32 of the cylinder head 17 through an insulator 21*a* and at a rear end portion thereof to the air cleaner 22 through a connecting tube 21*b*.

The main body 63 has a cylindrical form and has formed therein the body internal intake passage 63*a* of a circular cross section which extends linearly along a center axial line C4 which is inclined forwardly downwardly. The butterfly valve 64 is supported on the main body 63 through a pivot shaft 66 which extends along a diameter of the body internal intake passage 63*a*. The pivot shaft 66 is disposed horizontally and projects at the opposite end portions thereof outwardly of the main body 63. A throttle drum 67 is attached to a right end portion of the pivot shaft 66 such that the butterfly valve 64 can be operated to pivot through a throttle cable 75 by an operating element not shown.

The pivot shaft 66 engages at a left end portion thereof with a throttle opening sensor (not shown) in a sensor case 68 attached to the left side of the main body 63. It is to be noted that also an intake air temperature sensor and an intake air pressure sensor are included in the sensor case 68. The butterfly valve has a form of a circular flat plate and is pivoted only in one direction around the pivot shaft 66 to form openings of an equal area above and below the pivot shaft 66.

Referring to FIG. 3, the injector 65 is disposed at an upper end portion (top portion) of the main body 63 in the vertical direction in a posture in which a center axial line C5 thereof is inclined forwardly downwardly. At a front end 65*a* of the injector 65 which faces the body internal intake passage 63*a*, a pair of fuel injection ports (not shown) are provided which carry out fuel injection into two directions which are branched in a broadening manner equally between the left and right with respect to the center axial line C5.

Figure 10:
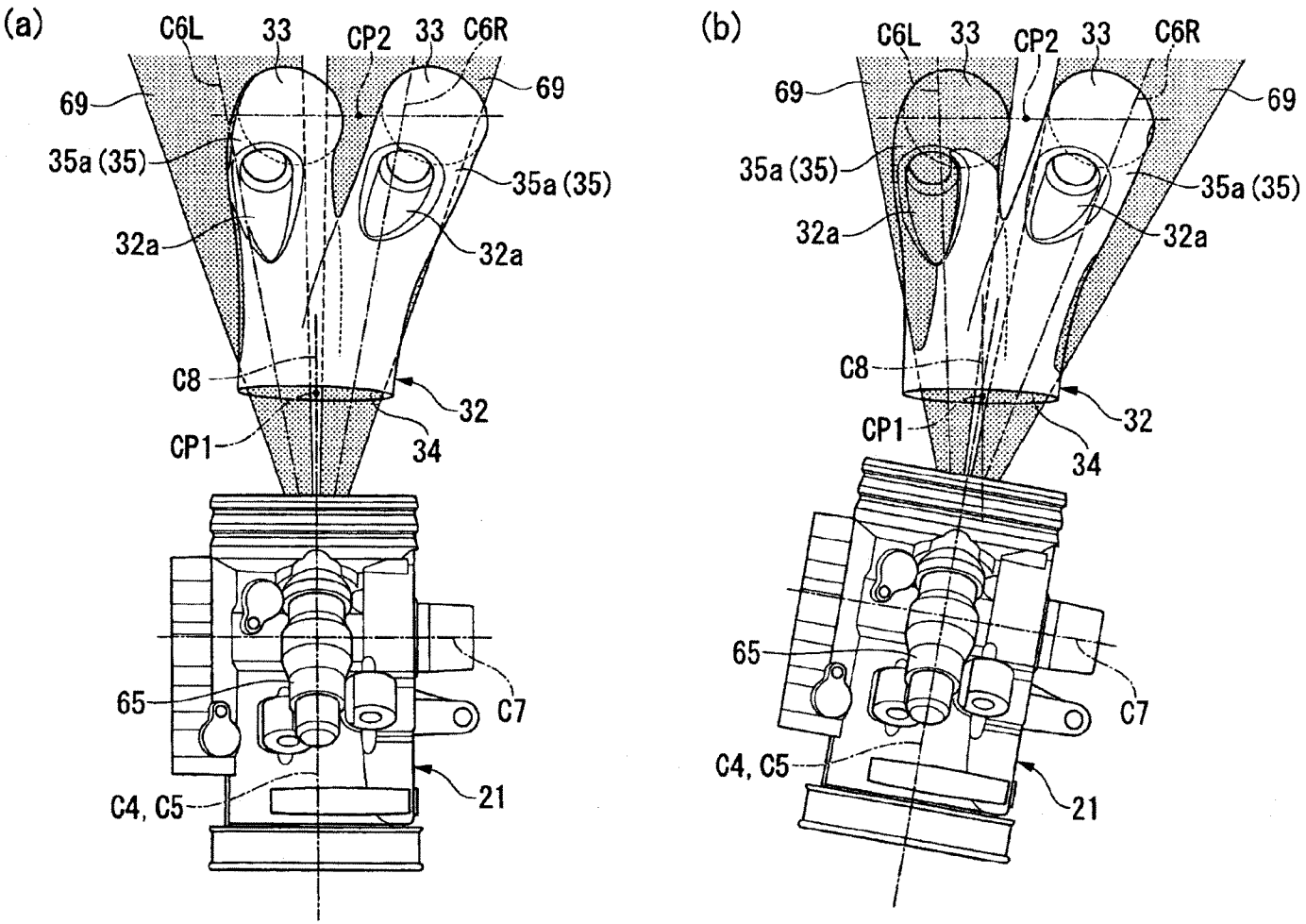
FIG. 10(*a*) is a view showing arrangement of an intake port and a throttle body in a comparative example as viewed from above, and FIG. 10(*b*) is a view showing such arrangement in the present embodiment as viewed from above.
Figure 11:
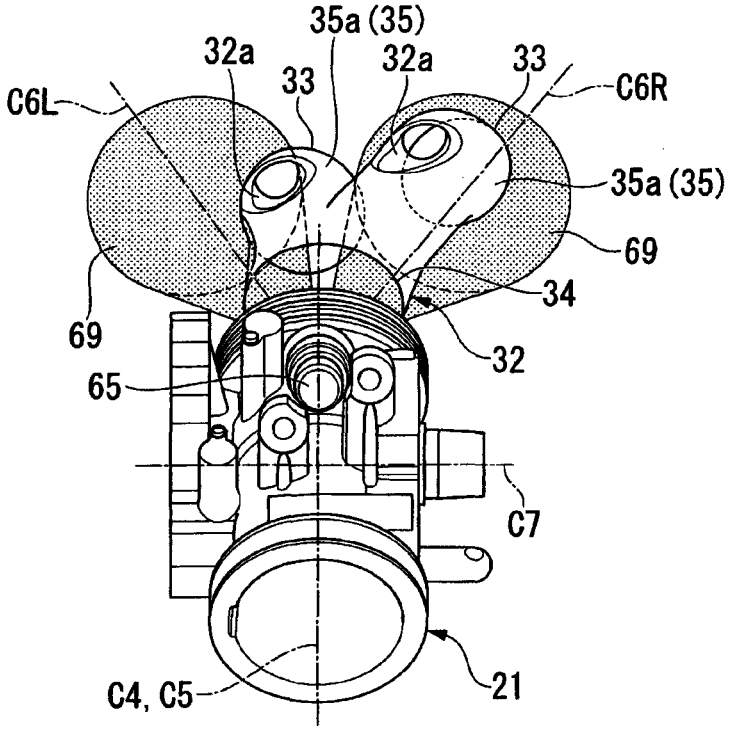
FIG. 11(*a*) is a view showing arrangement of the intake port and the throttle body in the comparative example as viewed from upwardly rearwardly, and FIG. 11(*b*) is a view showing such arrangement in the present embodiment as viewed from upwardly rearwardly.
Figure 11:
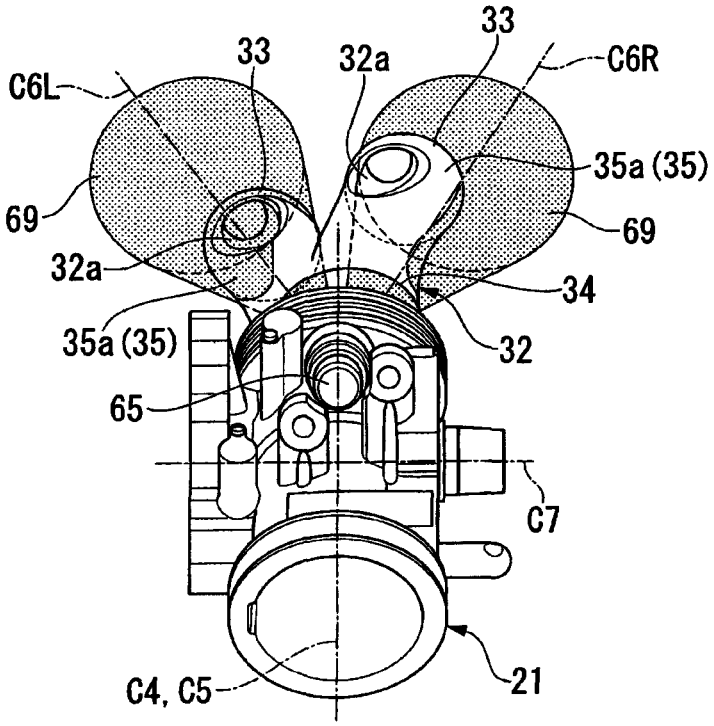

Referring also to FIGS. 10 and 11, the fuel injection in the two directions forms fuel sprays (spray foams) 69 of a conical shape. Center axial lines C6L and C6R of the fuel sprays 69 are disposed on a plane parallel to a center axial line C7 of the pivot shaft 66 disposed horizontally. In other words, the fuel sprays are formed so as to be disposed in a juxtaposed relationship on the left and right along the horizontal pivot shaft 66.

Meanwhile, the left and right intake downstream side openings 33 are juxtaposed in the cylinder leftward and rightward direction inclined with respect to the horizontal leftward and rightward direction. In the present embodiment, in order to carry out optimum fuel injection toward the left and right intake downstream side openings 33, the leftward and rightward fuel sprays 69 are deflected to one side in the cylinder leftward and rightward direction together with the throttle body 21 as hereinafter described to achieve enhancement in emission performance, engine output power and fuel cost while maintaining the versatility of the throttle body 21.

The injector 65 is disposed such that the center axial line C5 forms an acute angle with respect to the center axial line C4 of the main body 63 (the injector 65 is laid down) in order to allow the fuel sprays 69 to reach the downstream side of the intake port to the utmost. A fuel spray relief portion 71 for avoiding the fuel sprays 69 is provided in a concave manner at an upper end portion of the inner periphery of a front portion of the main body 63. The fuel spray relief portion 71 extends to a front end of the main body 63, and a second fuel spray relief portion 72 is provided in a concave manner at an upper end portion of the inner periphery of a rear portion of the insulator 21*a* in such a manner as to connect to the front of the fuel spray relief portion 71.

Figure 7:
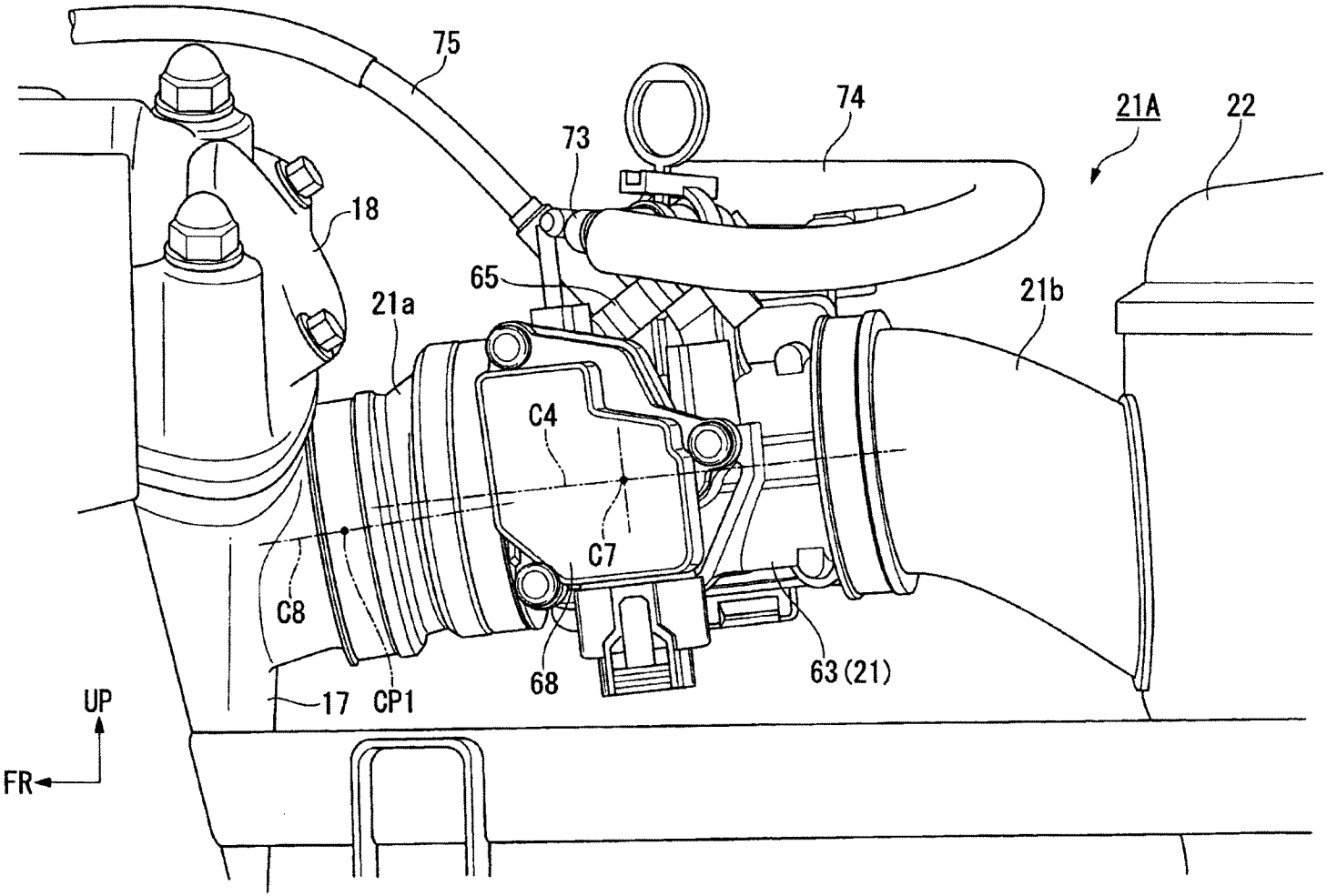
FIG. 7 is a left side elevational view showing a periphery of a throttle body of the engine.
Figure 8:
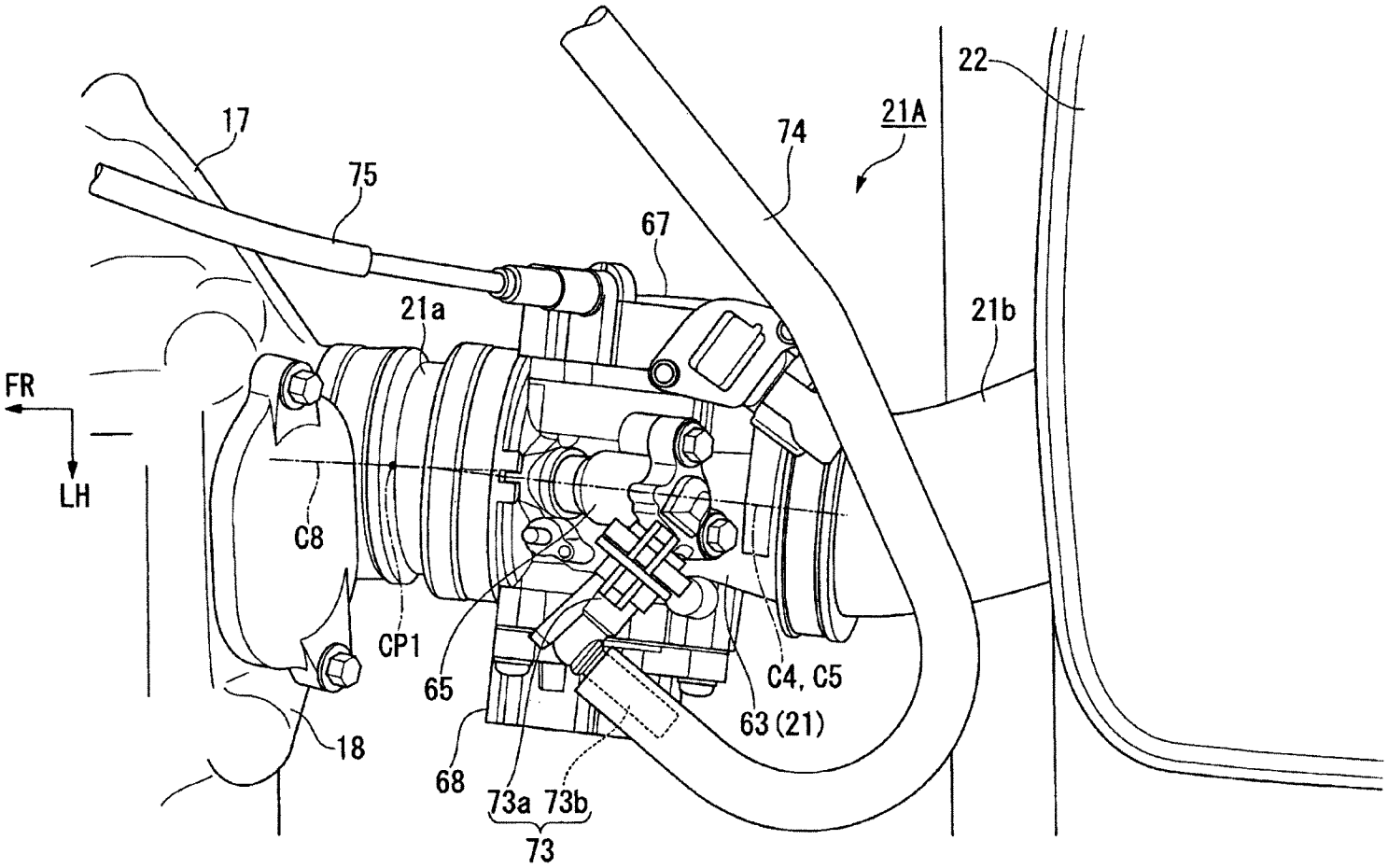
FIG. 8 is a top plan view showing the periphery of the throttle body of the engine.
Figure 9:
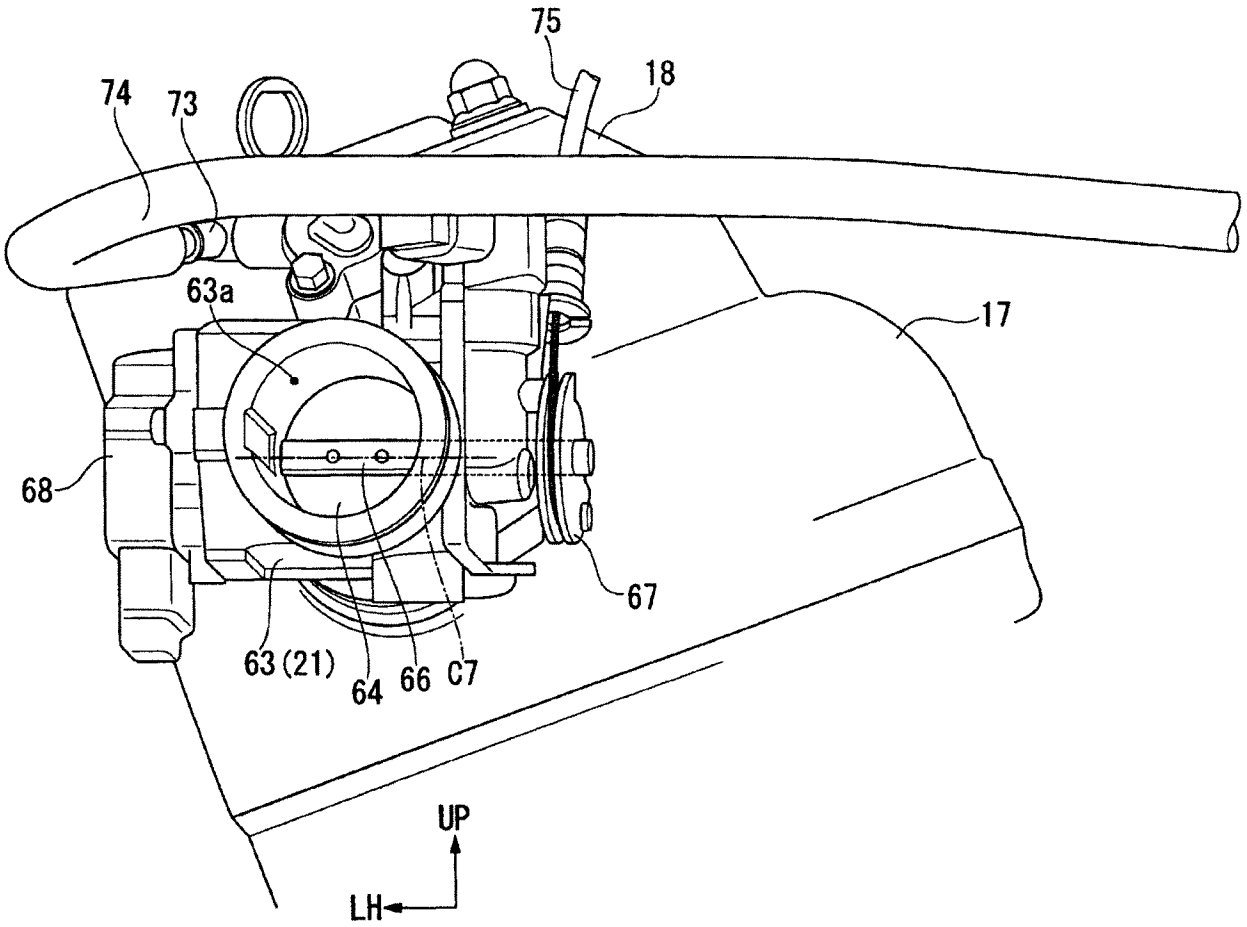
FIG. 9 is a rear elevational view showing the periphery of the throttle body of the engine.

Referring to FIGS. 7 to 9, a fuel hose 74 is connected to a rear end portion of the injector 65, which projects outwardly of the main body 63, through an L-shaped hose joint 73. The hose joint 73 integrally has a first edge portion 73*a* extending leftwardly forwardly from a rear end portion of the injector 65 and a second edge portion 73*b* extending leftwardly rearwardly from a left end portion of the first edge portion 73*a*. The second edge portion 73*b* is inserted in and held by an end portion of the fuel hose 74. The fuel hose 74 extends from a fuel pump not shown, extends substantially horizontally toward the left rear from an upper and right portion of the throttle body 21. The fuel hose 74 is also folded back to the right front leftwardly and rearwardly of the throttle body 21, and is fitted outwardly with the second edge portion 73*b*.

Referring to FIG. 5, the intake port 32 is formed such that a center position CP1 of the intake upstream side opening 34 is offset by a predetermined amount F to one side in one direction of a cylinder leftward and rightward direction of the intake downstream side openings 33 (to the left side in the cylinder leftward and rightward direction) with respect to a center position CP2 between the intake downstream side openings 33 in the cylinder leftward and rightward direction as viewed in the cylinder axial direction. Consequently, the left branch passage 35*a* extending to the left intake downstream side opening 33 is shorter and bent by a smaller amount than the right branch passage 35*a* which extends to the right intake downstream side opening 33.

Referring also to FIGS. 7 to 9, the intake upstream side opening 34 of the intake port 32 is provided such that a center axial line C8 thereof is inclined rearwardly upwardly as viewed in the cylinder leftward and rightward direction. Since the cylinder head 17 is inclined leftwardly, the center axial line C8 of the intake upstream side opening 34 is inclined rearwardly upwardly as viewed in side elevation and is slightly inclined also in plan view such that the rear side is positioned on the left side.

The throttle body 21 is inclined, as viewed in side elevation, rearwardly upwardly such that the center axial line C4 of the main body 63 has an angle a little smaller than the center axial line C8 of the intake upstream side opening 34. Further, the throttle body 21 is inclined, as viewed in plan, such that the center axial line C4 of the main body 63 forms an angle a little greater than the center axial line C8 of the intake upstream side opening 34 such that the rear side is positioned on the left side.

The angle variation of the center axial line C4 with respect to the center axial line C8 as viewed in side elevation is provided around the proximity of the pivot shaft 66. Therefore, the front end opening of the throttle body 21 is displaced upwardly with respect to the intake upstream side opening 34 of the intake port 32.

Meanwhile, the angle variation of the center axial line C4 with respect to the center axial line C8 as viewed in plan is provided around the proximity of the center position CP1 of the intake upstream side opening 34.

The front end 65*a* of the injector 65 is displaced a little leftwardly (to the offset side of the intake upstream side opening 34) with respect to the center axial line C8 of the intake upstream side opening such that fuel is injected from the position toward the counter offset side (rightwardly) of the intake upstream side opening 34.

The intake port 32 of FIGS. 10 and 11 shows an inner face shape, and dots similar to those of the fuel sprays 69 are marked in regions of the inner face shape which the fuel sprays 69 hit.

Referring to FIG. 10(*a*) and FIG. 11(*a*), if fuel is injected from the injector 65 in such arrangement that, in the intake port 32, the center axial line C8 of the intake upstream side opening 34 and the center axial line C5 of the injector 65 (which is a fuel injection center axis line and is a bisector of the angle between center axial lines C9L and C9R of the left and right fuel sprays 69) are registered as viewed in the cylinder axis direction, then the fuel sprays 69 are liable to flow in a one-sided state into the left branch passage 35*a* which exhibits comparatively low resistance. Also the two injection regions (spray foams) are less likely to hit an upper portion of the port inner wall (the fuel sprays 69 are likely to hit a lower portion of the port inner wall one-sidedly such that the fuel is likely to adhere to the same).

In contrast, with the engine 10 of the present embodiment, as viewed in the direction of the cylinder axis, the center axial line C5 of the injector 65 is inclined so as to be directed to the right side in the cylinder leftward and rightward direction with respect to the center axial line C8 of the intake upstream side opening 34 (to the counter offset side of the intake upstream side opening 34 so as to be inclined to the right side in the cylinder leftward and rightward direction).

Consequently, as seen in FIG. 10(*b*) and FIG. 11(*b*), one-sided inflow of the fuel sprays 69 is suppressed. Also the two injection regions become likely to also hit an upper portion of the port inner wall (fuel becomes less likely to adhere to a lower portion of the port inner wall).

In a port injection gasoline engine, if fuel adheres to a port inner wall, then part of the fuel sometimes flows directly into a cylinder while remaining in liquid phase without being vaporized (atomized). This may result in an increase of HC (Hydro Carbon) in the exhaust gas when the engine is cold, is in transition, or is running. Consequently degradation of the fuel costs and drivability may be exhibited.

However, by suppressing adhesion of fuel to the port inner wall, HC in the exhaust gas decreases and the emission performance is improved. Feedback control of fuel injection is carried out with a higher degree of accuracy, resulting in enhancement of the fuel cost and the drivability.

Further, since the second ignition plug 52 is positioned on the offset side of the intake upstream side opening 34, the arriving speed of fuel air mixture at the electrode portions of the second ignition plug 52 is increased, thereby suppressing fuel adhesion to the electrode portions. At this time, an air flow (swirl and so forth) in the combustion chamber 31 is promoted, and also the combustibility is enhanced.

As described above, the engine 10 in the embodiment described above is an internal combustion engine of the overhead valve type. In this type of engine, a plurality of intake valves 41 and a plurality of exhaust valves 42 are disposed in an opposing relationship to a piston 26, and are disposed on opposite sides between which a center axial line C2 of a cylinder head 17 is sandwiched. The internal combustion engine can include a first ignition plug 51 disposed on the inner side of an area 47 surrounded by the plural intake valves 41 and the plural exhaust valves 42 as viewed in the axial direction of the cylinder head 17 and standing uprightly along the center axial line C2, and a second ignition plug 52 inclined with respect to the center axial line C2 on the outer side of the area 47. The second ignition plug 52 is disposed on the opposite side to a valve driving mechanism 48A with respect to the cylinder axial line C2 on the outer side of the area 47.

With this configuration, different from an OHC engine in which the valve driving mechanism 48A (camshaft 48 or the like) is disposed on the inner side of the area 47, the internal combustion engine is an OHV engine in which the valve driving mechanism 48A is disposed on the outer side of the area 47. Therefore, the first and second plugs 51 and 52 are disposed such that the center axial lines C91 and C92 thereof are directed to the center direction of the combustion chamber 31 while the valve system is made compact. Consequently, it is possible to optimally control the ignition timing to achieve enhancement of the engine performance while the size of the engine main body is reduced.

Further, in the engine 10 described above, the center axial line C2 of the cylinder head 17 is inclined with respect to a vertical direction. The cylinder head 17 includes a first plug hole 53 which accommodates the first ignition plug 51 therein, a second plug hole 54 which is placed at a lower position in the vertical direction than that of the first plug hole 53 and accommodates the second ignition plug 52 therein, and a communicating passage 56 extending from a bottom portion of the first plug hole 53 to the second plug hole 54. Therefore, it is possible to guide rainwater and so forth accumulated in the first plug hole 53 into the second plug hole 54 through the communicating passage 56 to discharge the rainwater and so forth to the outer side of the cylinder head 17, providing a simplified draining structure.

Further, the engine 10 described above also includes a head side water jacket 58 for cooling in the inside of the cylinder head 17, and a head side opening 59 for communicating the head side water jacket 58 of the cylinder head 17. Further, a cylinder side water jacket 57 of a cylinder main body 16 is formed at a portion of a mating face 17*a* of the cylinder head 17 with the cylinder main body 16 in the proximity of the second plug hole 54. Consequently, the periphery of the second ignition plug can be positively cooled, and the temperature difference from the first ignition plug 51 can be reduced thereby to stabilize the ignition timing characteristic.

Further, the engine 10 described above also includes an intake port 32 configured to communicate two intake downstream side openings 33, which are opened and closed by the intake valves 41, and a single intake upstream side opening 34, to which an intake system part 21A is connected, with each other. The intake port 32 offsets a center position CP1 of the intake upstream side opening 34 to the second ignition plug 52 side in one direction of a cylinder leftward and rightward direction of the intake downstream side openings 33 with respect to a center position CP2 between the intake downstream side openings 33 in the one direction of the cylinder leftward and rightward direction as viewed in the axial direction of the cylinder head 17. Consequently, fuel adhesion to the electrode portions at the end of the second ignition plug 52 can be prevented while the arriving speed of fuel air mixture at the periphery of the second ignition plug is increased, and the ignition performance can be enhanced to achieve enhancement of the engine performance.

Further, in the engine 10 described above, the second ignition plug 52 ignites after ignition of the first ignition plug 51 at one combustion step. Consequently, abnormal combustion can be prevented even if lean fuel air mixture is used while the increase of the combustion pressure is moderated to reduce the load on the engine structure members, and the emission performance can be enhanced by combustion improvement by application of twin plugs.

It is to be noted that the present invention is not limited to the embodiment described above but may be applied to an engine, for example, not only for the four-wheeled vehicle described hereinabove but also for such a vehicle as a two-wheeled vehicle or a three-wheeled vehicle. Further, the present invention may be applied to a plural-cylinder engine such as a parallel or V type plural-cylinder engine or a horizontal engine having a crank axial line extending along the vehicle leftward and rightward direction.

Further, the configuration of the embodiment described above is an example of the present invention and can be modified in various manners without departing from the subject matter of the invention.

DESCRIPTION OF REFERENCE SYMBOLS

10 Engine (internal combustion engine)
16 Cylinder main body
17 Cylinder head
17*a* Mating face
Center axial line
21A Intake system part
26 Piston
32 Intake port
33 Intake downstream side opening CP2 Center position
34 Intake upstream side opening
CP1 Center position
41 Intake valve
42 Exhaust valve
47 Surrounded range
48A Valve driving mechanism
51 First ignition plug
52 Second ignition plug
53 First plug hole
54 Second plug hole
56 Communicating passage
57 Cylinder side water jacket (water jacket)
58 Head side water jacket (water jacket)
59 Head side opening (cooling water passage)

The invention claimed is:

1. An internal combustion engine of the overhead valve type in which a plurality of intake valves and a plurality of exhaust valves disposed in an opposing relationship to a piston are disposed on opposite sides between which a plane passing a cylinder axial line of a cylinder head is sandwiched, said engine comprising:

a first ignition plug disposed on an inner side of an area surrounded by the plurality of intake valves and the plurality of exhaust valves with said cylinder head viewed in parallel to the cylinder axial line and standing uprightly along the cylinder axial line; and a second ignition plug inclined with respect to the cylinder axial line on an outer side of the area, wherein said second ignition plug is disposed on one side of the engine with respect to the cylinder axial line on the outer side of the area, and a camshaft is entirely disposed on a second side of the engine with respect to the cylinder axial line opposite the second ignition plug.

2. The internal combustion engine according to claim 1, wherein the cylinder axial line is inclined with respect to a vertical direction, and wherein said cylinder head includes a first plug hole which accommodates said first ignition plug therein, a second plug hole which is placed at a lower position in the vertical direction than that of said first plug hole and accommodates said second ignition plug therein, and a communicating passage extending from a bottom portion of said first plug hole to said second plug hole.

3. The internal combustion engine according to claim 1, further comprising a first water jacket for cooling in an inside of said cylinder head, wherein a cooling water passage for communicating said first water jacket of said cylinder head and a second water jacket of a cylinder main body is opened at a portion of a mating face of said cylinder head with said cylinder main body in proximity to said second plug hole.

4. The internal combustion engine according to claim 1, further comprising an intake port configured to communicate two intake downstream side openings, which are opened and closed by said plurality of intake valves, and a single intake upstream side opening to which an intake system part is connected, wherein said intake port offsets a first center position of said intake upstream side opening to said second ignition plug side in one direction of a cylinder leftward and rightward direction of said intake downstream side openings with respect to a second center position between said intake downstream side openings in the one direction of the cylinder leftward and rightward direction with said cylinder head viewed in parallel to the cylinder axial line.

5. The internal combustion engine according to claim 1, wherein said second ignition plug is configured to ignite after ignition of said first ignition plug at one combustion step.

6. An internal combustion engine, comprising:

first ignition means for igniting a mixture, said first ignition means disposed on an inner side of an area surrounded by a plurality of intake valves and a plurality of exhaust valves in a cylinder head viewed in parallel to a cylinder axial line, wherein the plurality of intake valves and plurality of exhaust valves are disposed in an opposing relationship to a piston, and are disposed on opposite sides between which a plane passing a cylinder axial line is sandwiched, said first ignition means disposed upright along the cylinder axial line; and second ignition means inclined with respect to the cylinder axial line on an outer side of the area, wherein said second ignition means is disposed on one side of the engine with respect to the cylinder axial line on the outer side of the area, and a camshaft, for driving the plurality of intake valves and plurality of exhaust valves, is entirely disposed on a second side of the engine with respect to the cylinder axial line opposite the second ignition plug.

7. The internal combustion engine according to claim 6, wherein the cylinder axial line is inclined with respect to a vertical direction, and wherein said cylinder head includes a first plug hole for accommodating said first ignition means therein, a second plug hole disposed at a lower position in the vertical direction than that of the first plug hole, said second plug hole for accommodating said second ignition means therein, and a communicating passage extending from a bottom portion of the first plug hole to the second plug hole.

8. The internal combustion engine according to claim 6, further comprising:

first cooling means for cooling, said first cooling means disposed in an inside of the cylinder head, wherein water passage means is provide for communicating said first cooling means and a second cooling means of a cylinder main body is opened at a portion of a mating phase of the cylinder head with the cylinder main body in proximity to the second plug hole.

9. The internal combustion engine according to claim 6, further comprising intake means for communicating two intake downstream side openings which are opened and closed by said plurality of intake valves, and a single intake upstream side opening to which an intake system part is connected, wherein said intake means offsets a first center position of said intake upstream side opening to said second ignition means in one direction of a cylinder leftward and rightward direction of said intake downstream side openings with respect to a second center position between said intake downstream side openings in the one direction of the cylinder leftward and rightward direction with the cylinder head viewed in parallel to the cylinder axial line.

10. The internal combustion engine according to claim 6, wherein said second ignition means is configured to ignite after an ignition of said first ignition means at one combustion step.

11. An internal combustion engine, comprising:

a first ignition plug disposed on an inner side of an area surrounded by a plurality of intake valves and a plurality of exhaust valves in a cylinder head viewed in parallel to a cylinder axial line, wherein the plurality of intake valves and plurality of exhaust valves are disposed in an opposing relationship to a piston, and are disposed on opposite sides between which a plane passing a cylinder axial line is sandwiched, said first ignition plug being disposed upright along the cylinder axial line; and a second ignition plug inclined with respect to the cylinder axial line on an outer side of the area, wherein said second ignition plug is disposed on one side of the engine with respect to the cylinder axial line on the outer side of the area, and a camshaft is entirely disposed on a second side of the engine with respect to the cylinder axial line opposite the second ignition plug.

12. The internal combustion engine according to claim 11, wherein the cylinder axial line is inclined with respect to a vertical direction, and wherein the cylinder head includes a first plug hole for accommodating said first ignition plug therein, and a second plug hole disposed at a lower position in the vertical direction than that of the first plug hole, said second plug hole configured to accommodate the second ignition plug therein, and wherein a communicating passage extends from a bottom portion of the first plug hole to the second plug hole.

13. The internal combustion engine according to claim 11, further comprising:

a first water jacket configured to cool in an inside of said cylinder head, wherein a cooling water passage is configured to communicate the first water jacket and a second water jacket of a cylinder main body is opened at a portion of a mating phase of said cylinder head with said cylinder main body in proximity to said second plug hole.

14. The internal combustion engine according to claim 11, further comprising an intake port configured to communicate two intake downstream side openings, which are opened and closed by said plurality of intake valves, and a single intake upstream side opening to which an intake system part is connected, wherein said intake port offsets a first center position of said intake upstream side opening to said second plug side in one direction of a cylinder leftward and rightward direction of said intake downstream side openings with respect to a second center position between said intake downstream side openings in the one direction of the cylinder leftward and rightward direction with said cylinder head viewed in parallel to the cylinder axial line.

15. The internal combustion engine according to claim 11, wherein said second ignition plug is configured to ignite after an ignition of said first ignition plug at one combustion step.

* * * * *